US007249484B2

(12) United States Patent
Takashima et al.

(10) Patent No.: US 7,249,484 B2
(45) Date of Patent: Jul. 31, 2007

(54) METHOD FOR MANUFACTURING A LIQUID EJECTION HEAD

(75) Inventors: Nagamitsu Takashima, Nagano (JP); Ryoji Uesugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 379 days.

(21) Appl. No.: 10/915,713

(22) Filed: Aug. 11, 2004

(65) Prior Publication Data

US 2005/0057615 A1 Mar. 17, 2005

(30) Foreign Application Priority Data

Aug. 12, 2003 (JP) ..... P2003-292467

(51) Int. Cl.
*B21D 28/26* (2006.01)

(52) U.S. Cl. ..... 72/335; 29/890.1

(58) Field of Classification Search ..... 72/335, 72/324, 379.2; 29/890.1, 890.142, 890.143; 347/71

See application file for complete search history.

(56) References Cited

U.S. PATENT DOCUMENTS 3,338,084 A * 8/1967 Stegman, Sr. ..... 72/333
5,144,709 A 9/1992 Rooney
5,706,695 A * 1/1998 Helms et al. ..... 72/335
6,082,001 A * 7/2000 Bettelini ..... 29/893.33
6,189,363 B1 * 2/2001 Lai ..... 72/358
6,499,836 B1 12/2002 Usui et al.
6,968,616 B2 * 11/2005 Nakamura et al. ..... 29/890.1

FOREIGN PATENT DOCUMENTS

JP 2000-263799 A 9/2000

OTHER PUBLICATIONS

Chinese Office Action issued on Apr. 21, 2006.

* cited by examiner

*Primary Examiner*—Daniel C. Crane
(74) *Attorney, Agent, or Firm*—Sughrue Mion, PLLC

(57) ABSTRACT

There is provided a first die, in which a plurality of projections are arrayed in a first direction with a fixed pitch to form at least one array of the projections. Each of the projections is elongated in a second direction perpendicular to the first direction. The first die faces a first face of the plate member. A second die is opposed to the first die while supporting a second face of the plate member. At least one first region is formed on the plate member so as to have a less rigidity than another region of the plate member. The first die and the second die are approached so that the projections are dug into a second region in the first face of the plate member, thereby forming partitioned recesses to be pressure generating chambers of a liquid ejection head. The at least one first region is adjacent to at least one of ends in the first direction of the second region, such that the first region and the second region are arranged in the second direction.

8 Claims, 17 Drawing Sheets

METHOD FOR MANUFACTURING A LIQUID EJECTION HEAD

BACKGROUND OF THE INVENTION

The present invention relates to a liquid ejection head and a method of manufacturing the same.

The liquid ejection head ejects pressurized liquid from a nozzle orifice as a liquid droplet, and the heads for various liquids have been known. An ink jet recording head is representative of the liquid ejection head. Here, the related art will be described with the ink jet recording head as an example.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber and the common ink reservoir is more narrowed than the pressure generating chamber in a flow path width thereof in order to use ink pressure at inside of the pressure generating chamber efficiently for ejection of ink drops. Further, it is important for normal discharge of ink droplets that ink supply ports that communicate with the pressure generating chambers and the nozzle orifices be formed correctly at prescribed positions of the pressure generating chambers.

To form the pressure generating chambers and the ink supply ports having such minute structures with high dimensional accuracy, very fine forging work is performed on a metal material plate (see Japanese Patent Publication No. 2000-263799A, for example).

As shown in FIG. 19, the pressure generating chambers are produced by forming a large number of elongated recess portions 71 in a metal material plate 70 and then performing finish working on the elongated recess portions 71. The elongated recess portions 71 are formed by pressing the material plate 70 between dies, that is, a first die 72 and a second die 73. In the first die 72, a large number of projections 74 for formation of the elongated recess portions 71 are arranged parallel with each other and gaps 76 for formation of partitions 75 of the pressure generating chambers are provided between the projections 74. Dummy projections 77 for formation of dummy recesses are located at end portions of the first die 72.

FIG. 18A shows the material plate 70 that has been subjected to the plastic working by the first die 72 and the second die 73.

The elongated recess portions 71 formed by the plastic working are arrayed to form a recess array. In a normal section 79 that is distant from the end of the recess array, the elongated recess portions 71 are formed with the prescribed length. However, in an abnormal section 80 in the vicinity of the end of the recess array, the length of the elongated recess portions 71 is getting shorter than the prescribed length toward the array end (a dummy recess 78). This situation is represented by a dimensional difference D between the end of the recess portion 71 in the normal section 79 and the end of the dummy recess portion 78 which is the shortest one.

There are several phenomena that are considered the causes of the above dimensional difference D. Among those phenomena, a special phenomenon relating to plastic flows occurring in the material plate 70 during plastic working would be the most influential factor. More specifically, in the normal section 79, when the projections 74 are dug into the material plate 70, plastic flows in the longitudinal direction of the projections 74 occur as intended while the flowing material goes into the gaps 76 to form sufficiently high partitions 75, because the adjoining projections 74 prevent plastic flows in the arrayed direction of the elongated recess portions 71. Therefore, the elongated recess portions 71 in the normal section 79 are given uniform lengths and their ends are aligned straightly.

On the other hand, in the abnormal section 80, since no elongated recess portion 71 exists outside the dummy recess portion 78, when the projection is dug into the portion of the material plate 70 that corresponds to the dummy recess portion 78, the material flows outward in the arrayed direction of the elongated recess portions 71 without being restricted. Because of this flow, the amount of material flowing in the longitudinal direction of the elongated recess portions 71 during the formation of the dummy recess portion 78 decreases, as a result of which the dummy recess portion 78 formed is shorter than the prescribed length. The above plastic flow in the arrayed direction of the elongated recess portions 71, which is permitted in forming the dummy recess portion 78, affects the formation of the elongated recess portion 71 next to the dummy recess portion 78 and the material also flows in the arrayed direction though the amount is smaller, as a result of which the elongated recess portion 71 formed is shorter than the prescribed length. Likewise, the material also flows in the arrayed direction in forming the elongated recess portion 71 that is second next to the dummy recess portion 78 though the amount is even smaller, as a result of which the elongated recess portion 71 formed is shorter than the prescribed length. This is a chain-reaction-like phenomenon. The degree of shortage in the length of the elongated recess portion 71 decreases as the position comes closer to the normal section 79, to form a smooth line connecting the ends of elongated recess portions 71 that are located around the boundary between the abnormal section 80 and the normal section 79. The dimensional difference D occurs as a result of the above phenomenon.

In summary, it is considered that the dimensional difference D is caused by the phenomenon that the plastic flows of material in the longitudinal direction of the elongated recess portions 71 in the abnormal section 80 are reduced by the occurrence of the plastic flows of material in the arrayed direction of the elongated recess portions, in particular, the occurrence of the plastic flow of material that is directed outward of the dummy recess portion 78.

Although not shown in FIG. 18A, an equivalent dimensional difference D may occur at both ends of the recess array.

Since short elongated recess portions 71 are formed as described above, the positions of the communicating ports that communicate with the pressure generating chambers and the nozzle orifices are not made uniform relative to the ends of the elongated recess portions 71. This results in various problems; for example, the working load of boring punches for forming the communicating ports becomes unduly heavy, ink is prevented from flowing smoothly to impair bubble ejection, and variations in the capacity and the shape of the pressure generating chambers cause an abnormality in the ink droplet discharge characteristics.

The most serious problem is that the working load of boring punches becomes unduly heavy. FIG. 18C shows a state that a communicating port 81 has been formed in an elongated recess portion 71 in the normal section 79. A first communicating port 81*a* having a large cross section and a closed bottom is formed by digging a boring punch through the middle or lower part of a slant face 82 at the end portion of the elongated recess portion 71. A second communicating port 81*b* is then formed by digging another boring punch into the bottom portion of the first communicating port 81*a*, whereby a two-step communicating port 81 is completed. A boring stroke S1 of the boring punch that is applied to the normal section 79 as in the above case is short and hence the working load of the boring punch is relatively light.

On the other hand, FIG. 18D shows a state that a communicating port 81 is formed in an elongated recess portion 71 in the abnormal section 80. Since the boring punches are aligned straightly, if the elongated recess portion 71 is shorter than the prescribed length by the dimensional difference D, a first communicating port 81*a* is formed at a position close to the top end of a slant face 82. Therefore, a boring stroke S2 is much longer than the boring stroke S1 so that strong lateral stress is exerted on the thin boring punch. As a result, the life of the boring punches to be applied to the abnormal section 80 is much shortened. And the frequency of breakage of the boring punches increases. Such shortening of the life causes a state that the punches cannot be used for the abnormal section 80 though they can well exercise the punching function for the normal section 79. This is uneconomical because the punches need to be replaced earlier. Further, frequent replacement of the punches lowers the productivity.

FIG. 18B shows a recess 83 that is formed so as to extend in the arrayed direction of the elongated recess portions 71. The recess 83 is provided to shape the end portions of the elongated recess portions 71 sharply and to keep the top surface of the material plate 70 flat. Without the recess 83, when the projections 74 of the first die 72 are dug into the material plate 70, the material that flows in the longitudinal direction of the elongated recess portions 71 would form a rise as indicated by dashed chain lines in this figure. Such a rise exerts reaction force on the end portions of the projections 74 being dug, as a result of which the end portions of the elongated recess portions 71 are not formed sharply. Further, the rise would lower the flatness of the top surface of the chamber formation plate. The formation of the recess 83 solves the above problems because it absorbs the material flowing thereinto that would otherwise form the rise.

SUMMARY OF THE INVENTION

It is therefore an object of the invention to provide a method of manufacturing a liquid ejection head, capable of aligning the longitudinal ends of all the arrayed elongated recess portions, thereby improving the ejection property of the liquid ejection head.

It is also an object of the invention to provide a method of manufacturing a liquid ejection head, capable of reducing working loads exerted to punches for boring the communicating ports, thereby elongating the life of the punches.

In order to achieve the above objects, according to the invention, there is provided a method of manufacturing a liquid ejection head which ejects liquid droplets from nozzle orifices by generating pressure fluctuation in liquid contained in a plurality of pressure generating chambers communicated with the nozzle orifices, comprising steps of:

providing a metallic plate member;

providing a first die, in which a plurality of projections are arrayed in a first direction with a fixed pitch to form at least one array of the projections, each of the projections being elongated in a second direction perpendicular to the first direction, the first die facing a first face of the plate member;

providing a second die, opposed to the first die while supporting a second face of the plate member;

forming at least one first region on the plate member so as to have a less rigidity than another region of the plate member;

approaching the first die and the second die, so that the projections are dug into a second region in the first face of the plate member, the projections being pressed in a third direction orthogonal to the first direction and the second direction, so as to generate a plastic flow of a material in the plate member into gaps defined between the projections, thereby forming partitioned recesses to be the pressure generating chambers, wherein the at least one first region is adjacent to at least one of ends in the first direction of the second region, such that the first region and the second region are arranged in the second direction.

With this configuration, the plastic flow in the second direction occurring from the end in the first direction of the second region are not restricted, and hence the partitioned recesses in the vicinity of the array end can be given the prescribed length.

In other words, according to the plastic deformation of the first region, the amount of the plastic flow in the second direction is made relatively greater than that in the first direction, and hence the "array-end" recesses can be given the prescribed length.

Further, since the plastic flow is permitted around the first region during action of the first die, the end portions in the second direction of the "array-end" recesses can be formed sharply.

Preferably, the method further comprises a step of forming a through hole in each of the partitioned recesses, the through hole to be a passage communicating one of the pressure generating chambers and one of the nozzle orifices. The through hole is formed in the vicinity of one end in the second direction of each of the partitioned recesses, which opposes to the first region.

Since the digging positions of the boring punches are made identical with respect to the partitioned recesses, forces exerted to the boring punches can be made least, so that the life of the boring punches can be elongated. Elongating the life of the boring punches makes it possible to, for example, save the cost relating to working tools and increase the replacement cycle of the boring punches. Further, since the accuracy of formation of the partitioned recesses is increased, the capacity and the shape of the pressure generating chambers are made uniform and the ink ejecting characteristics can thereby be improved.

Preferably, the projections in the first die is arranged so as to form two arrays of the projections, and the first region is placed between two arrays of the projections when the projections are dug into the plate member.

In this case, the lengths of the two sets of recesses can be corrected by the single first region, which is efficient.

Preferably, a through hole or a recess is formed in the first region. In this case, the first region can be formed by simple punching, whereby the manufacturing process is simplified. Moreover, the deformation of the first region well conforms to plastic flow in the second direction occurring from the second region.

Preferably, a distance between the first region and the second region is made shorter as coming closer to an end in the first direction of the second region.

In this case, the distances can be optimized in accordance with the necessary amounts of plastic flows in the second direction occurring from the second region. As a result, the lengths of the partitioned recesses are equalized and the longitudinal ends thereof are aligned straightly.

Here, it is preferable that the first region has a trapezoidal shape such that a longer side is made closer to the end in the first direction of the second region.

In this case, a plastic flow from the end in the first direction of the second region reaches the first region immediately, whereby the portion of the first region close to the longer side is given largest plastic deformation. On the other hand, at a portion where is distant from the end in the first direction of the second region, plastic flows from second region do not reach the first region immediately, whereby the portion of the first region close to the shorter side is given only slight plastic deformation.

In a case where the projections in the first die is arranged so as to form two arrays of the projections, it is preferable that the trapezoidal shape is symmetrical with respect to a line extending in the first direction.

Preferably, the method further comprises a step of forming a recess extending in the first direction, such that the first region is situated within the recess.

In this case, the recess realizes securing of sufficient flatness of the plate member and correction of the lengths of the "array-end" recesses, thereby simplifying the manufacturing process.

According to the invention, there is also a liquid ejection head, comprising:

a metallic plate member, comprising:

a first face, having a first region formed with a plurality of recesses which are arrayed in a first direction, each of the recesses being elongated in a second direction perpendicular to the first direction; and a second face, formed with a plurality of holes each of which is communicated with one of the recesses;

an elastic plate, joined to the first face of the plate member so as to seal the recesses to form the pressure generating chamber; and a nozzle plate, joined to the second face of the plate member, the nozzle plate formed with a plurality of nozzle orifices from which the liquid droplets are ejected, each of the nozzle orifice being communicated with one of the holes, wherein at least one opening is adjacent to at least one of ends in the first direction of the first region, such that the first region and the opening are arranged in the second direction.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below with reference to the accompanying drawings. Firstly, the constitution of a liquid ejection head will be described.

Since it is preferable to apply the invention to a recording head of an ink jet recording apparatus, as an example representative of the liquid ejection head, the above recording head is shown in the embodiment.

Figure 1:
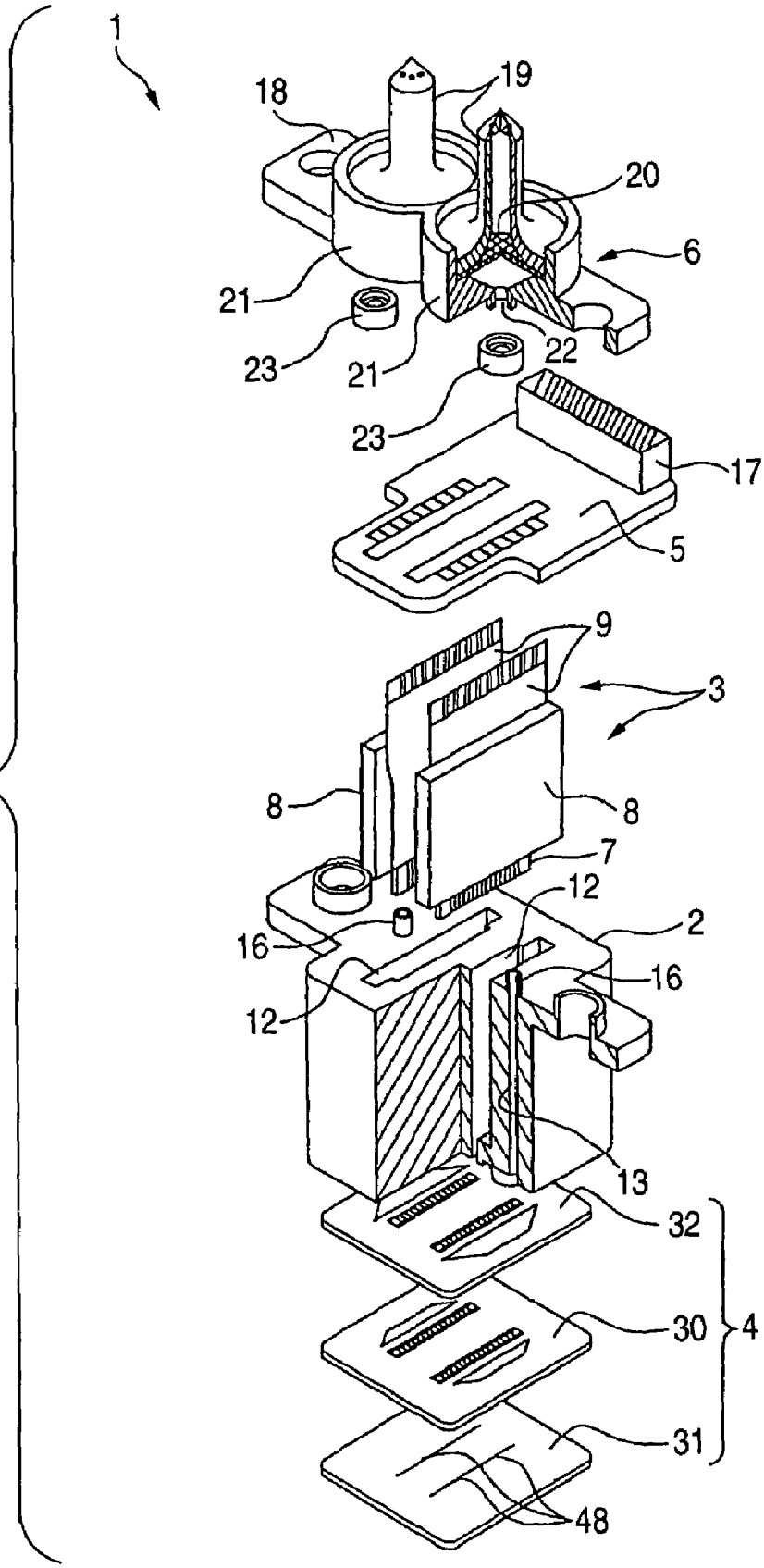
FIG. 1 is a perspective view of a disassembled ink jet recording head according to a first embodiment of the invention.
Figure 2:
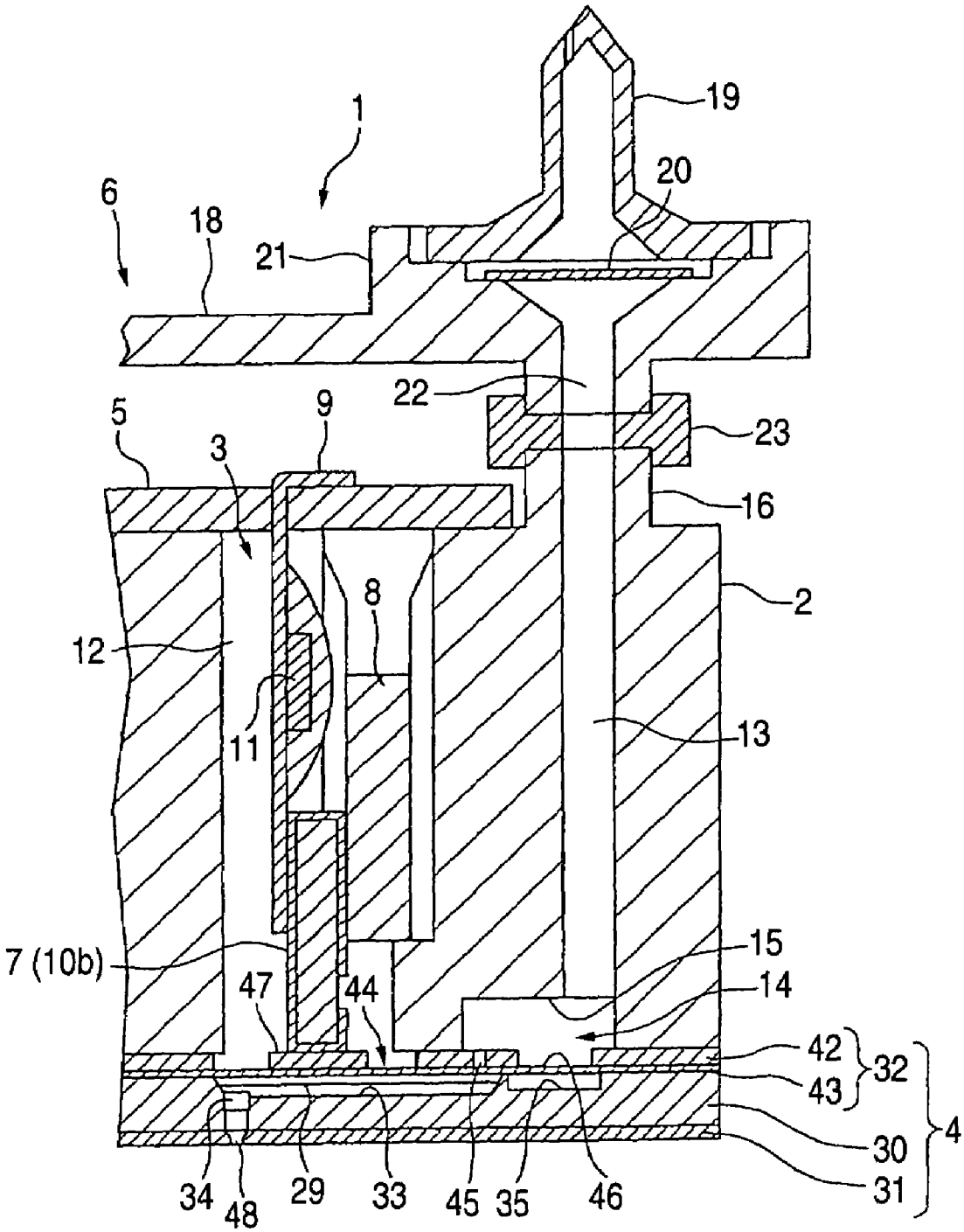
FIG. 2 is a sectional view of the ink jet recording head.

As shown in FIGS. 1 and 2, a recording head 1 is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 3A:
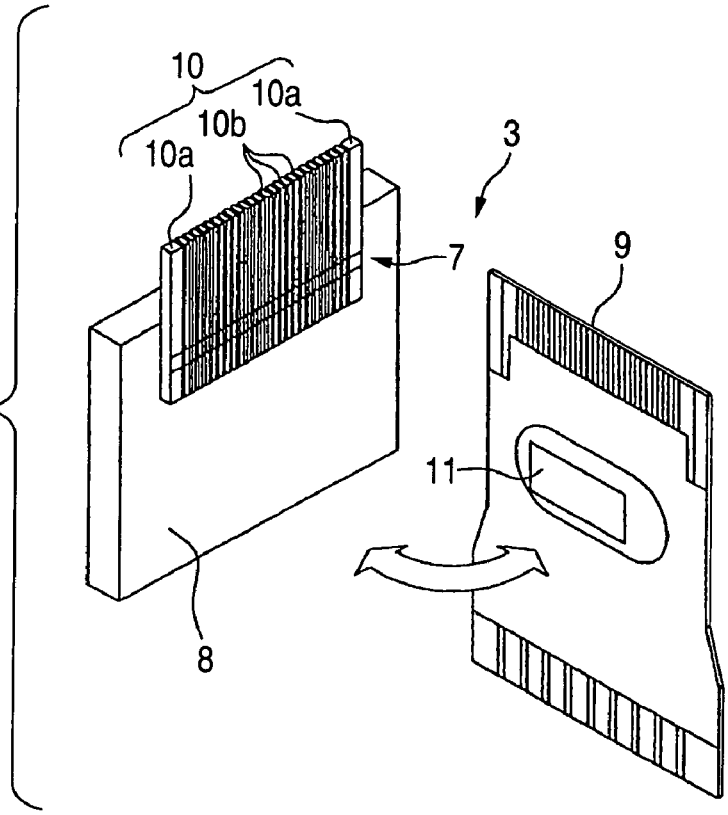
FIGS. 3A and 3B are views for explaining a vibrator unit.
Figure 3B:
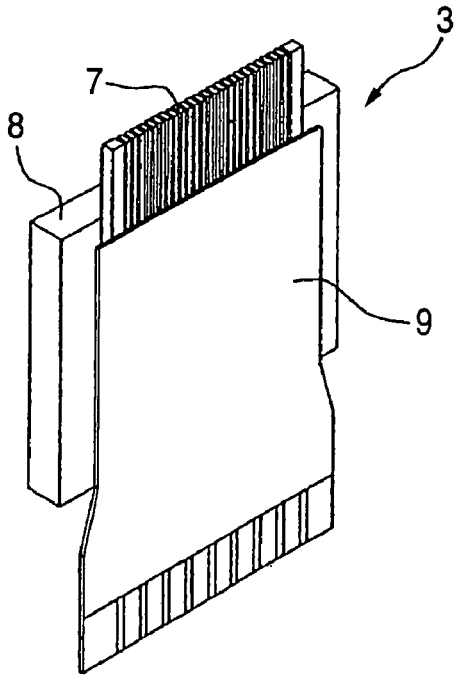

As shown in FIGS. 3A and 3B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 μm through 100 μm, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-shaped member having a rigidity capable of receiving reaction force from the piezoelectric vibrators 10, and a metal plate of a stainless steel plate or the like is preferably used therefor.

The casing 2 is a block-shaped member molded by a thermosetting resin of an epoxy species resin or the like. Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink. Further, the front end face of the casing 2 is formed with a recess 15 for constituting a common ink reservoir 14.

The container chamber 12 is a hollow portion having a size of capable of containing the vibrator unit 3. At a portion of a front end side of the container chamber 12, a step portion is formed such that a front end face of the fixation plate 8 is brought into contact therewith.

The recess 15 is formed by partially recessing the front end face of the casing 2 so has to have a substantially trapezoidal shape formed at left and right outer sides of the container chamber 12.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge. A distal end portion of the ink supply needle 19 is sharpened in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 2, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

Figure 4:
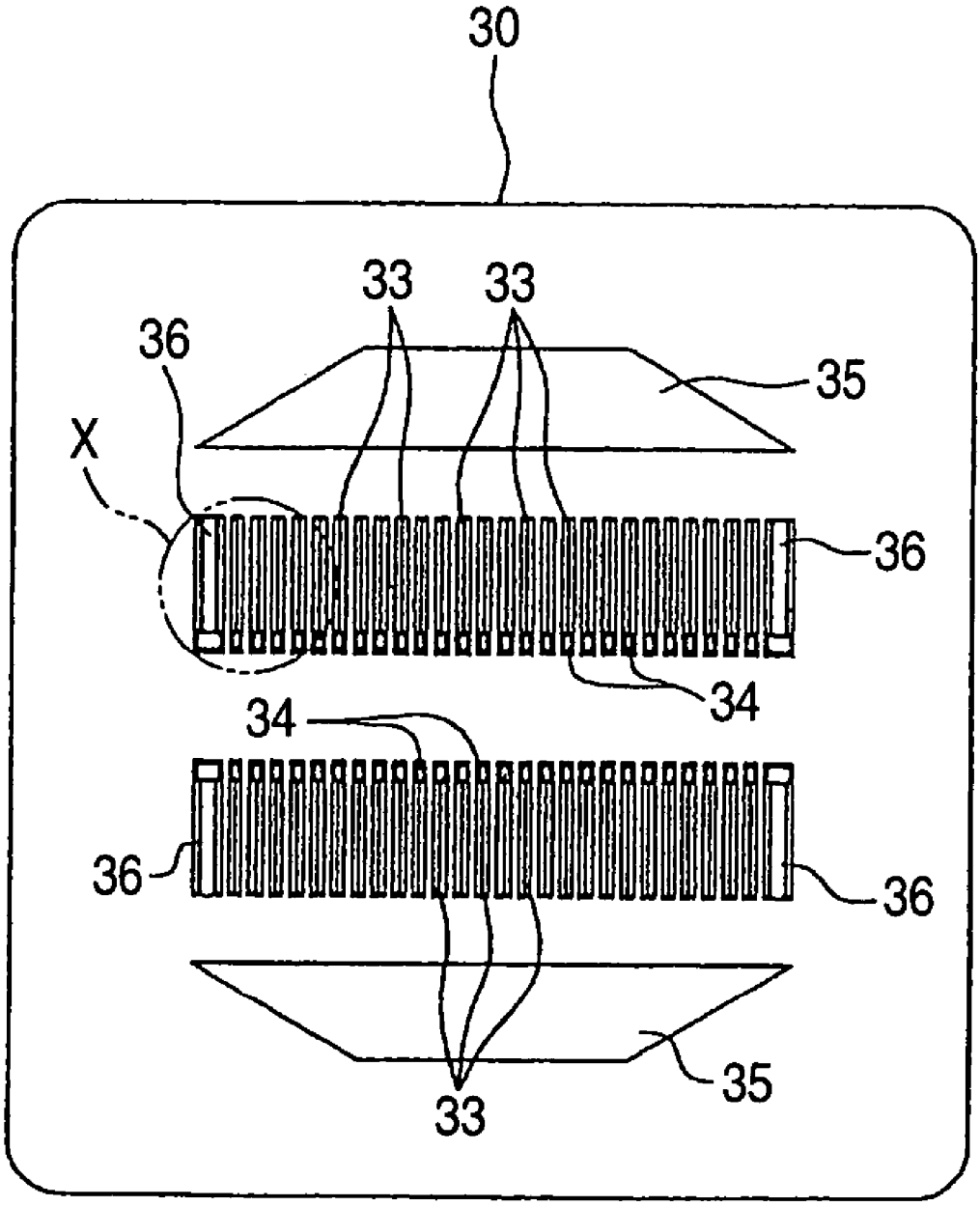
FIG. 4 is a plan view of a chamber formation plate.

As shown in FIG. 4, the chamber formation plate 30 is a plate-shaped member made of a metal formed with an elongated recess portion 33, a communicating port 34 and an escaping recess portion 35. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate.

As a result, even when the adhering temperature is set to high temperature, the respective members can be adhered to each other without trouble. Further, even when the piezoelectric vibrator 10 generates heat in operating the recording head 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 5A:
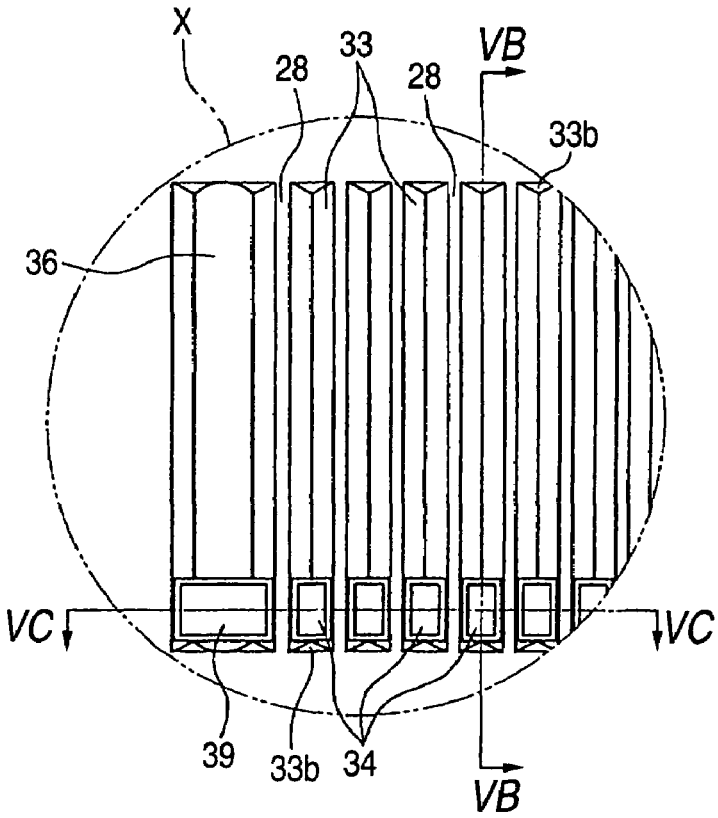
FIG. 5A is a view enlarging an X portion in FIG. 4.

The elongated recess portion 33 is a recess portion in a groove-shaped shape constituting a pressure generating chamber 29 and is constituted by a groove in a linear shape as shown to enlarge in FIG. 5A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-shaped shape by reducing a width thereof as progressing in a depth direction (that is, depth side). The bottom face is recessed in the V-shaped shape to increase a rigidity of a partition wall 28 for partitioning the contiguous pressure generating chambers 29. That is, by recessing the bottom face in the V-shaped shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-shaped shape, the elongated recess portion 33 can be formed with excellent dimensional accuracy by plastic working (to be mentioned later). Further, an angle between the inner faces of the recess portion 33 is, for example, around 90 degrees although prescribed by a working condition.

Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33. The dummy recess portion 36 is a recess portion in a groove-shaped shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-shaped shape. This is also for increasing the rigidity of the partition wall 28 and forming the dummy recess portion 36 with excellent dimensional accuracy by plastic working.

Further, a row of recesses is constituted by the respective elongated recess portions 33 and the pair of dummy recess portions 36. According to the embodiment, two rows of the recesses are formed as shown in FIG. 4.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Therefore, in the embodiment, the working is divided into two steps. In the first step, the first communicating port 37 is formed halfway in the plate thickness direction, and in the second step, the second communicating port 38 is formed. The working process of this communicating port 34 will be described later.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

The escaping recess portion 35 forms an operating space of a compliance portion 46 (described later) in the common ink reservoir 14. According to the embodiment, the escaping recess portion 35 is constituted by a recess portion in a trapezoidal shape having a shape substantially the same as that of the recess 15 of the casing 2 and a depth equal to that of the elongated recess portion 33.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

Figure 6:
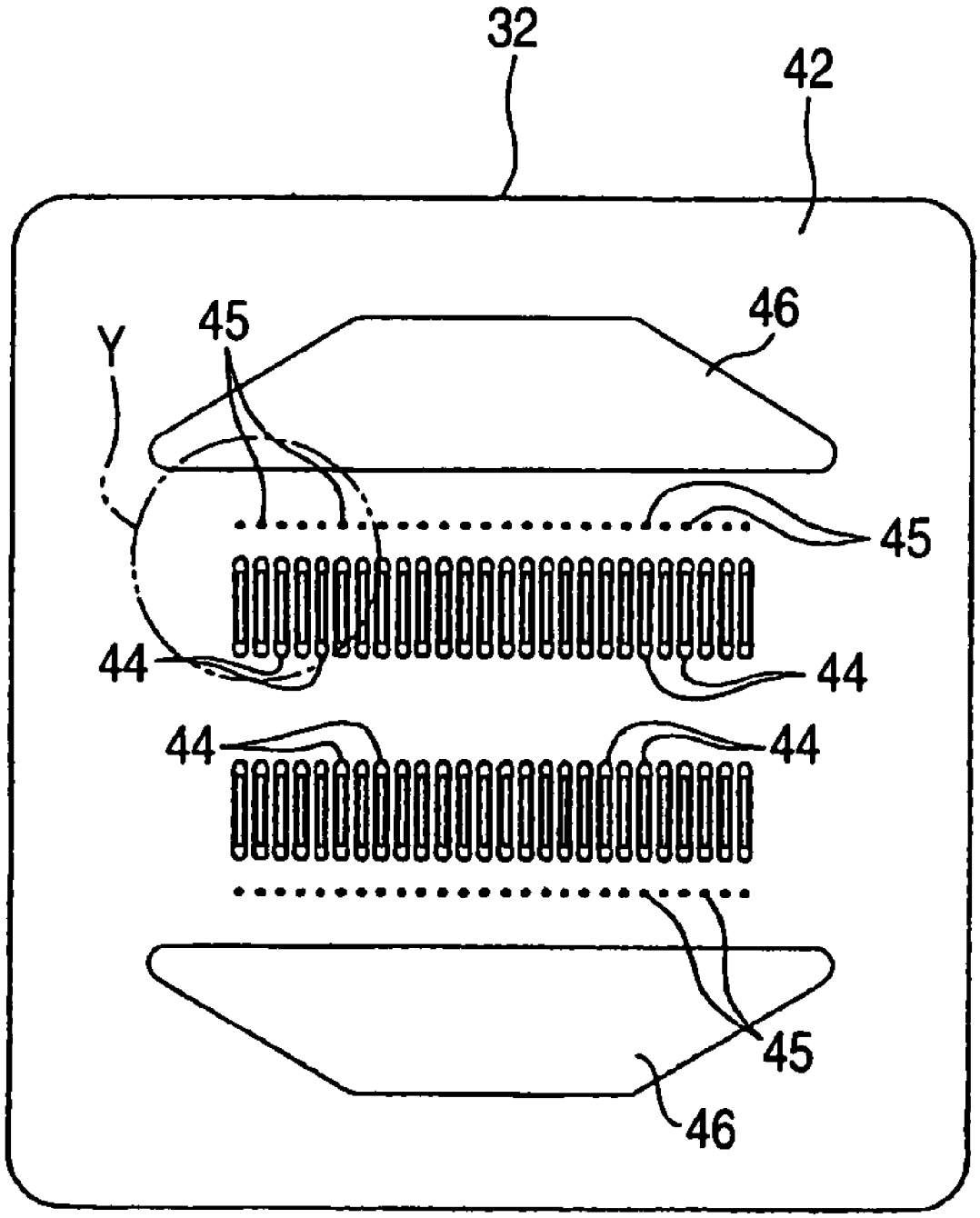
FIG. 6 is a plan view of an elastic plate.

As shown in FIG. 6, the elastic plate 32 is formed with a diaphragm portion 44, an ink supply port 45 and the compliance portion 46.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 7A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 2, one end of the diaphragm portion 44 is aligned to one end of the elongated recess portion 33 (end portion on a side of the communicating port 34).

Figure 7B:
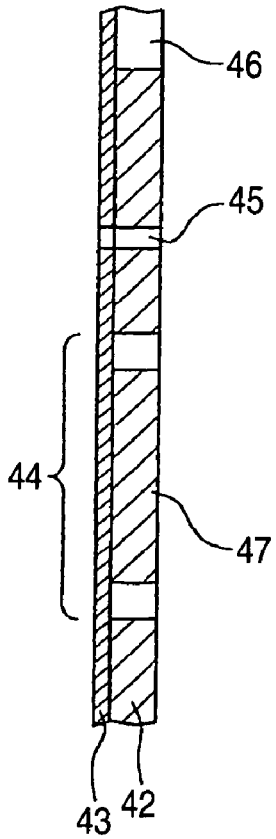
FIG. 7B is a sectional view taken along a line VIIB-VIIB of FIG. 7A.
Figure 7A:
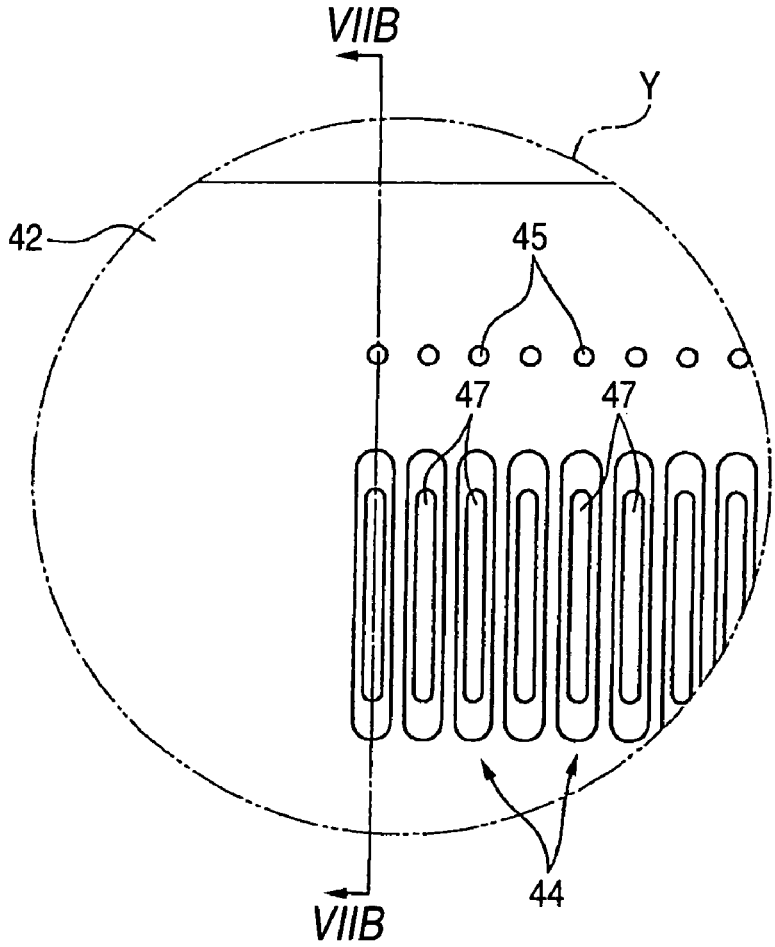
FIG. 7A is a view enlarging a Y portion of FIG. 6.

As shown in FIG. 7B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 2, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment, the ink supply port 45 is constituted by a small through hole of 23 μm.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

The compliance portion 46 is a portion for partitioning a portion of the common ink reservoir 14. That is, the common ink reservoir 14 is formed to partition by the compliance portion 46 and the recess 15. The compliance portion 46 is of a trapezoidal shape substantially the same as an opening shape of the recess 15 and is fabricated by removing a portion of the support plate 42 by etching or the like to constitute only the elastic film 43.

Further, the support plate 42 and the elastic film 43 constituting the elastic plate 32 are not limited to the example. Further, polyimide may be used as the elastic film 43. Further, the elastic plate 32 may be constituted by a metal plate provided with a thick wall and a thin wall at a surrounding of the thick wall for constituting the diaphragm portion 44 and a thin wall for constituting the compliance portion 46.

Further, when the above-described elastic plate 32 is bonded to one surface of the chamber formation plate 30, that is, a face thereof for forming the elongated recess portion 33, the diaphragm portion 44 seals the opening face of the elongated recess portion 33 to form to partition the pressure generating chamber 29. Similarly, also the opening face of the dummy recess portion 36 is sealed to form to partition the dummy pressure generating chamber. Further, when the above-described nozzle plate 31 is bonded to other surface of the chamber formation plate 30, the nozzle orifice 48 faces the corresponding communicating port 34. When the piezoelectric vibrator 10 bonded to the island portion 47 is extended or contracted under the state, the elastic film 43 at a surrounding of the island portion is deformed and the island portion 47 is pushed to the side of the elongated recess portion 33 or pulled in a direction of separating from the side of the elongated recess portion 33. By deforming the elastic film 43, the pressure generating chamber 29 is expanded or contracted to provide a pressure variation to ink at inside of the pressure generating chamber 29.

When the elastic plate 32 (that is, the flow path unit 4) is bonded to the casing 2, the compliance portion 46 seals the recess 15. The compliance portion 46 absorbs the pressure variation of ink stored in the common ink reservoir 14. That is, the elastic film 43 is deformed in accordance with pressure of stored ink. Further, the above-described escaping recess portion 35 forms a space for allowing the elastic film 43 to be expanded.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-shaped shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment, the ink supply port 45 for communicating the common ink reservoir 14 and the pressure generating chamber 29 is constituted by the small hole penetrating the elastic plate 32 in the plate thickness direction, high dimensional accuracy thereof is easily achieved by laser machining or the like. Thereby, an ink flowing characteristic into the respective pressure generating chambers 29 (flowing velocity, flowing amount or the like) can be highly equalized. Further, when the fabrication is carried out by the laser beam, the fabrication is also facilitated.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plate 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop ejection characteristics of all the pressure generating chambers 29 of the one row can be made to be equal to each other.

With regard to the dummy pressure generating chamber, the width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

According to the embodiment, the recess 15 is formed by partially recessing the front end face of the casing 2, the common ink reservoir 14 is formed to partition by the recess 15 and the elastic plate 32, an exclusive member for forming the common ink reservoir 14 is dispensed with and simplification of the constitution is achieved. Further, the casing 2 is fabricated by resin dieing, fabrication of the recess 15 is also relatively facilitated.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The chamber formation plate 30 is fabricated by forging by a progressive die. Further, a metal strip 55 (referred to as "strip 55" in the following explanation) used as a material of the chamber formation plate 30 is made of nickel as described above.

The steps of manufacturing the chamber formation plate 30 comprises steps of forming the elongated recess portion 33 and steps of forming the communicating port 34 which are carried out by a progressive die.

Figure 5B:
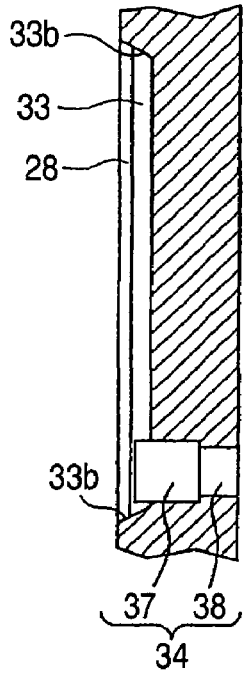
FIG. 5B is a sectional view taken along a line VB-VB of FIG. 5A.
Figure 5C:
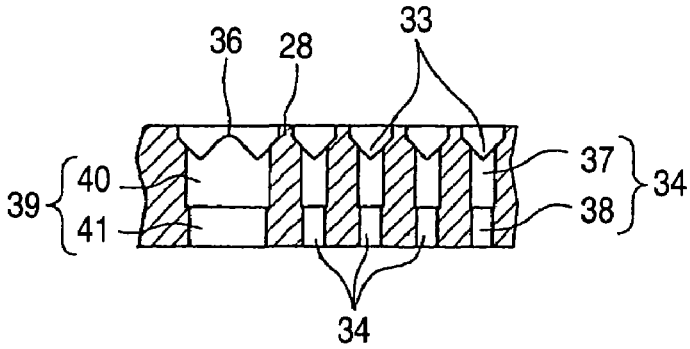
FIG. 5C is a sectional view taken along a line VC-VC of FIG. 5A.
Figure 8A:
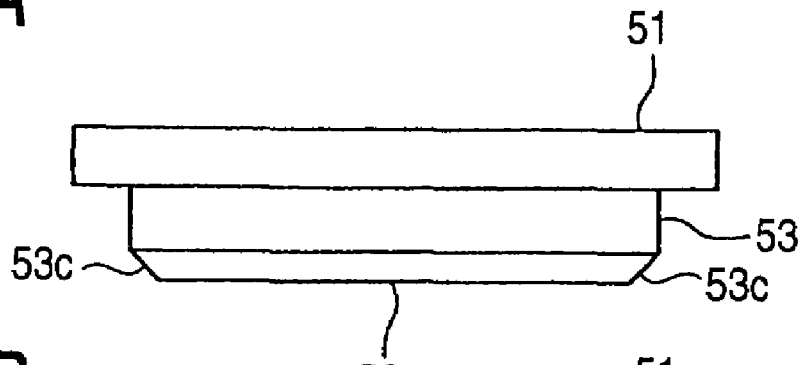
FIGS. 8A and 8B are views for explaining a first die used in forming an elongated recess portion.
Figure 8B:
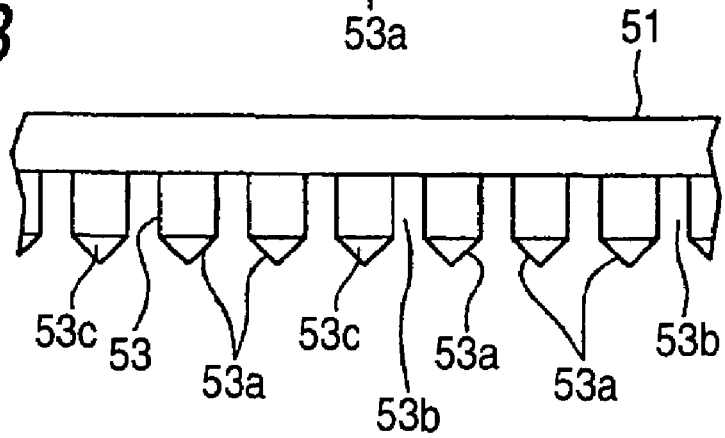
Figure 9A:
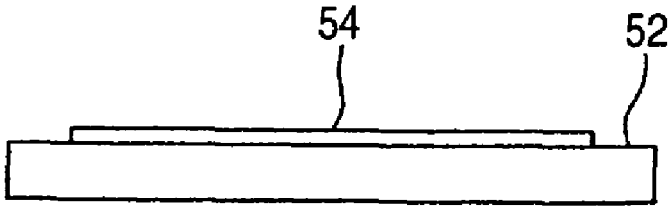
FIGS. 9A and 9B are views for explaining a second die used in forming the elongated recess portion.
Figure 9B:
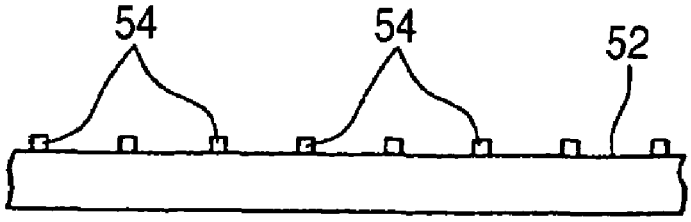

In the elongated recess portion forming steps, a male die 51 shown in FIGS. 8A and 8B and a female die shown in FIGS. 9A and 9B are used. The male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 36. A distal end portion 53*a* of the projection 53 is tapered from a center thereof in a width direction by an angle of about 45 degrees as shown in FIG. 8B. Thereby, the distal end portion 53*a* is sharpened in the V-shaped shape in view from a longitudinal direction thereof. Further, both longitudinal ends 53*c* of the distal end portions 53*a* are tapered by an angle of about 45 degrees as shown in FIG. 8A. Therefore, the distal end portion 53*a* of the projection 53 is formed in a shape of tapering both ends of a triangular prism. Slope faces 33*b* at the longitudinal ends of the elongated recess portions 33 (see FIG. 5B) are formed by the tapered portions 53*c*.

Further, the female die 52 is formed with a plurality of projections 54 at an upper face thereof. The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

Figure 10A:
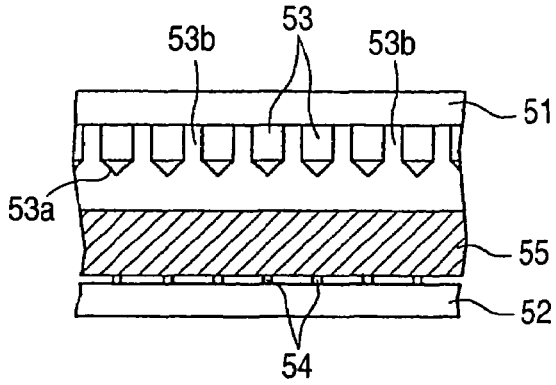
FIGS. 10A to 10C are views for explaining steps of forming the elongated recess portion.
Figure 10B:
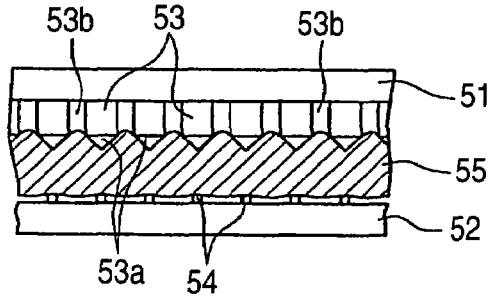
Figure 10C:
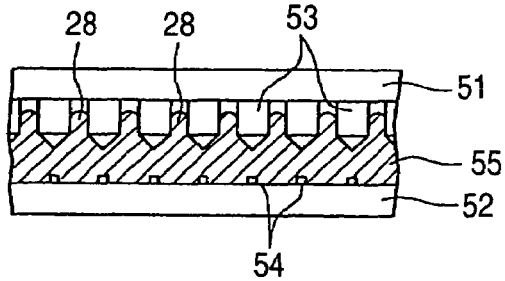

In the elongated recess portion forming steps, first, as shown in FIG. 10A, the strip 55 is mounted at an upper face of the female die 52 and the male die 51 is arranged on an upper side of the strip 55. Next, as shown in FIG. 10B, the male die 51 is moved down to push the distal end portion of the projection 53 into the strip 55. At this occasion, since the distal end portion 53*a* of the projection 53 is sharpened in the V-shaped shape, the distal end portion 53*a* can firmly be pushed into the strip 55 without buckling. Pushing of the projection 53 is carried out up to a middle in a plate thickness direction of the strip 55 as shown in FIG. 10C.

Figure 10D:
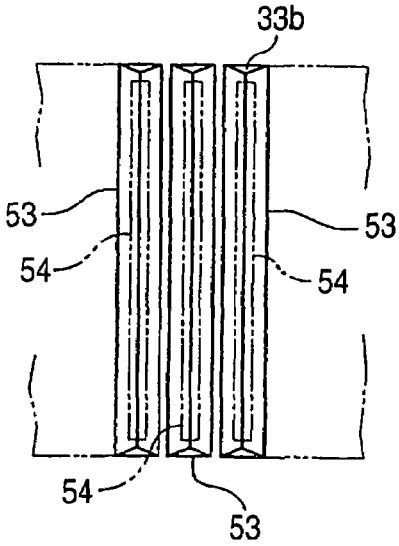
FIG. 10D is a plan view for explaining a positional relationship between the first die and the second die.

By pushing the projection 53, a portion of the strip 55 flows to form the elongated recess portion 33. In this case, since the distal end portion 53*a* of the projection 53 is sharpened in the V-shaped shape, even the elongated recess portion 33 having a small shape can be formed with high dimensional accuracy. That is, the portion of the strip 55 pushed by the distal end portion 53*a* flows smoothly, the elongated recess portion 33 to be formed is formed in a shape following the shape of the projection 53. Further, since the both longitudinal ends 53*c* of the distal end portion 53*a* are tapered, the strip 55 pushed by the portions also flows smoothly. Therefore, also the both end portions in the longitudinal direction of the elongated recess portion 33 are formed as the slope faces 33*b* with high dimensional accuracy as shown in FIG. 10D.

Since pushing of the projection 53 is stopped at the middle of the plate thickness direction, the strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the strip 55 is raised into a space between the contiguous projections 53 by being pressed by the projections 53. In this case, the projection 54 provided at the female die 52 is arranged at a position in correspondence with an interval between the projections 53, flow of the strip 55 into the space is assisted. Thereby, the strip 55 can efficiently be introduced into the space between the projections 53 and the protrusion (i.e., the partition wall 28) can be formed highly.

Figure 11:
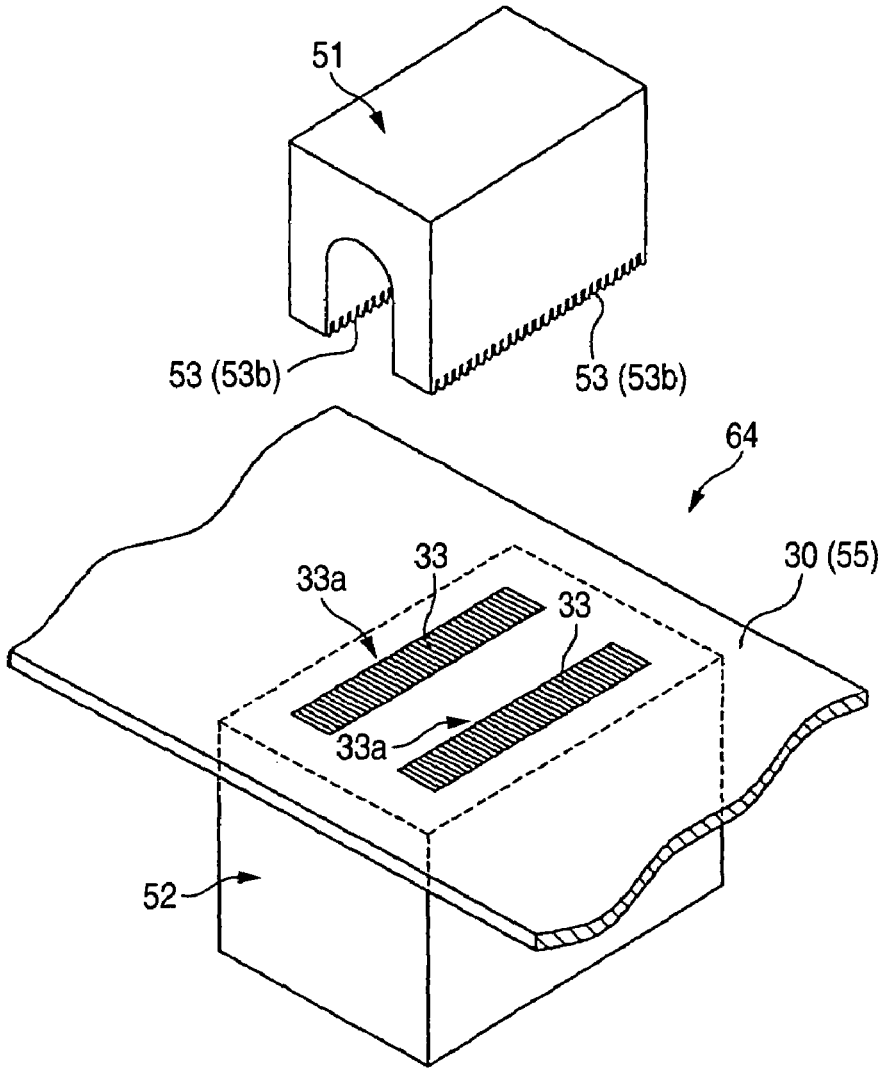
FIG. 11 is a perspective view showing positional relationships between the first die, a material plate, and the second die.

FIG. 11 shows positional relationships between the first die 51, the second die 52, the material plate 55. The elongated recess portions 33 are arrayed to form two arrays 33*a* of the elongated recess portions 33.

The above-described plastic working on a strip (material plate) 55 using the first die 51 and the second die 52 is performed at ordinary temperature. Likewise, plastic working that will be described below is performed at ordinary temperature.

Figure 12A:
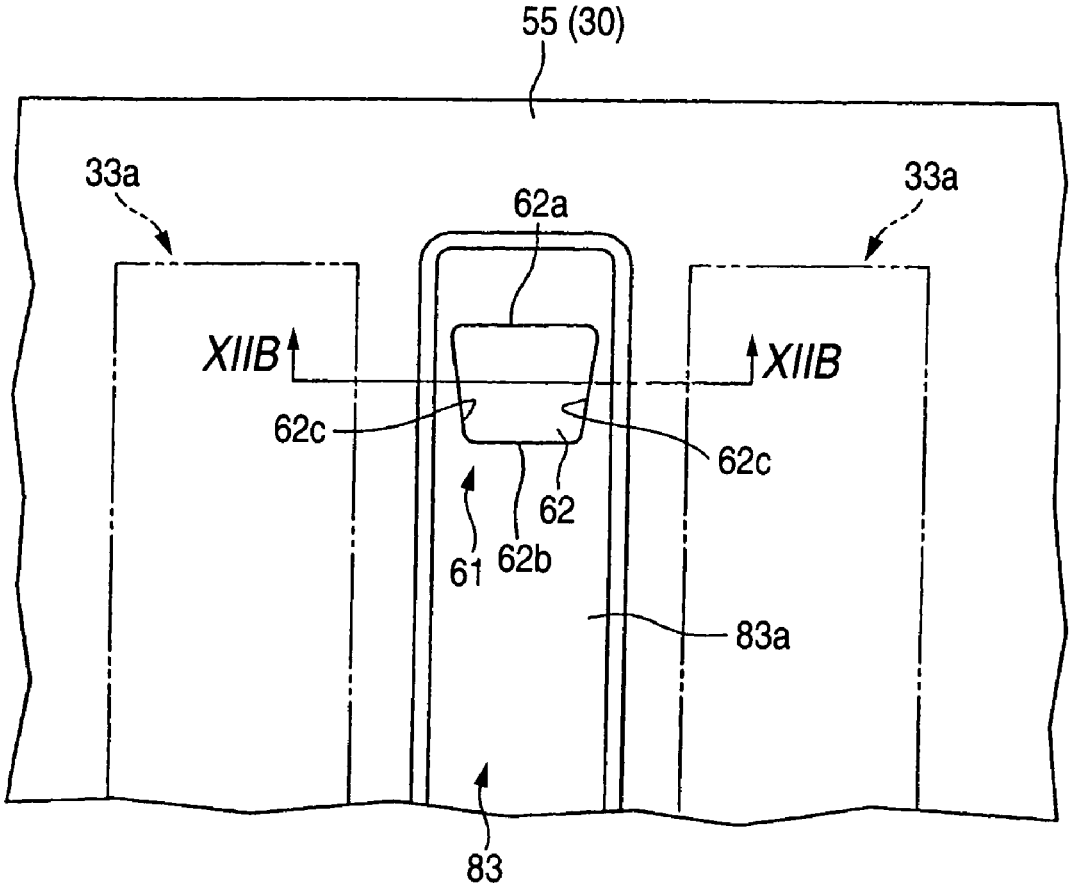
FIG. 12A is a plan view of a chamber formation plate according to a first embodiment of the invention, showing a state before the elongated recess portions are formed.

FIG. 12 shows how a material plate 55 is moved in a progressive forging apparatus. The material plate 55 is progressively transferred rightward in this figure. In a preforming process 63, various kinds of boring, recess formation, etc. are performed on the nickel material plate 55. Typical structures formed are the escaping recess portions 35. The elongated recess portions 33 are formed by a main process 64 that is executed after the preforming process 63.

Regions enclosed by dashed chain lines in FIG. 12 are regions where the arrays 33*a* of elongated recess portions 33 to be the pressure generating chambers 29 and dummy recess portions 36 are to be formed.

A recess 83 is formed in the preforming process at a portion between the two arrays 33*a* of elongated recess portions 33 so as to extend in the arrayed direction of the elongated recess portions 33. As described above with reference to FIGS. 18A and 18B, the recess 83 is provided to secure sufficient flatness of the chamber formation plate 30 and to sharply form the longitudinal end portions of the elongated recess portions 33.

Figure 12B:
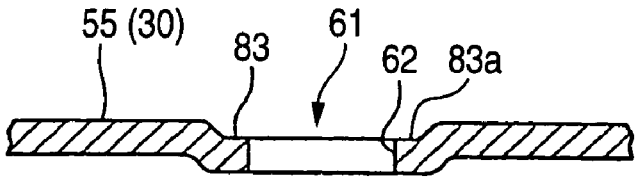
FIG. 12B is a section view taken along a line XIIB-XIIB.
Figure 18A:
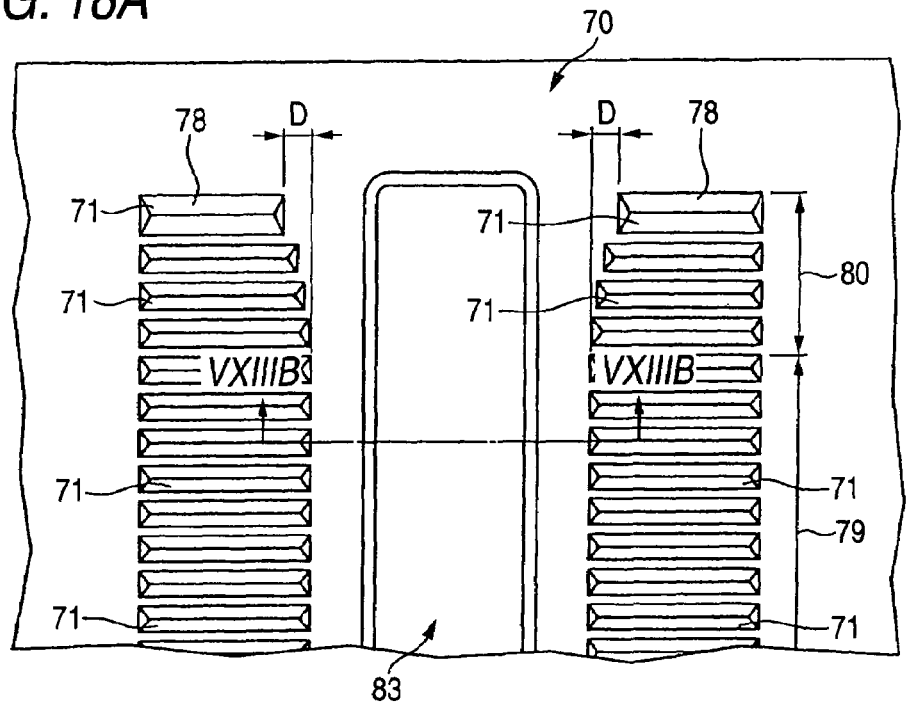
FIG. 18A is a plan view of a chamber formation plate incorporated in a conventional liquid ejection head.
Figure 18B:
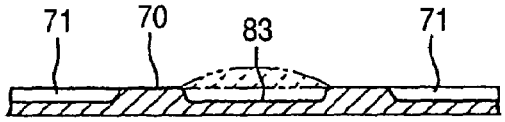
FIG. 18B is a section view taken along a line XVIIIB-XVIIIB in FIG. 18A.

In this embodiment, the dummy recess portion 36 and four elongated recess portions 33 in the vicinity of the end of the array 33*a* correspond to the abnormal section 80 shown in FIG. 18A. These recess portions 33, 36 are referred as "array-end" elongated recess portions. A low rigidity portion 61 is provided in advance at a position that is separated from the ends of the five array-end elongated recess portions 33 and 36 by a prescribed distance in the longitudinal direction of the elongated recess portions 33 and 36. As shown in FIG. 12B, the low rigidity portion 61 of this embodiment is a trapezoidal opening 62 that penetrates through the material plate 55. The trapezoidal shape is symmetrical with respect to its center line extending along the arrayed direction of the elongated recess portions 33, and a longer side 62*a* is located on the side of the dummy recess portion 36.

The trapezoidal opening 62 is formed by punching a bottom portion 83*a* of the recess 83 that is formed in advance. Therefore, the order of execution of manufacturing steps is such that after the formation of the recess 83 and the punching-out of the opening 62 are performed in this order as the preforming process, the formation of the elongated recess portions 33 by the first die 51 and the formation of the communicating ports 34 and the dummy communicating ports 39 are performed as the main processing.

The dimensions of the trapezoidal opening 62 are set so as to be suitable for the width, length, and depth of the elongated recess portions 33 and 36, the thickness of the chamber formation plate 30, and other factors. In this embodiment, the lengths of the longer side 62*a* and the shorter side 62*b* are 0.86 mm and 0.48 mm, respectively, and the distance between the longer side 62*a* and the shorter side 62*b* is 0.73 mm.

In the trapezoidal shape, edges 62*c* that connect the longer side 62*a* and the shorter side 62*b* are inclined from the arrayed direction of the elongated recess portions 33. With this configuration, the distance between the longitudinal end of the array-end recess portion 33 (36) and the opposing edge 62*c* of the low rigidity portion 61 decreases gradually as the position comes closer to the dummy recess portion 36.

Figure 18C:
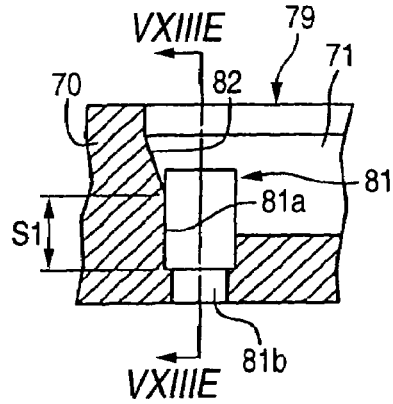
FIG. 18C is a section view of an elongated recess portion and a communicating port in a normal section in the chamber formation plate of FIG. 18A.
Figure 18D:
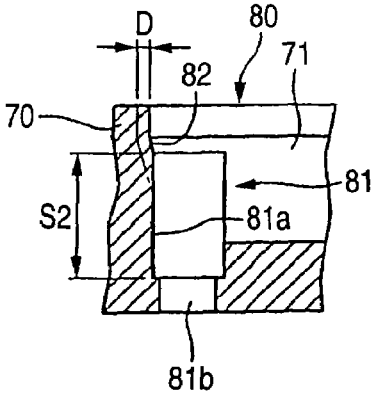
FIG. 18D is a section view of an elongated recess portion and a communicating port in an abnormal section in the chamber formation plate of FIG. 18A.
Figure 18E:
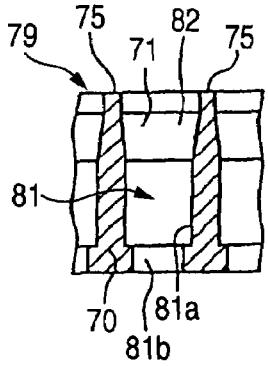
FIG. 18E is a section view taken along a line XVIIIE-XVIIIE in FIG. 18C.
Figure 19:
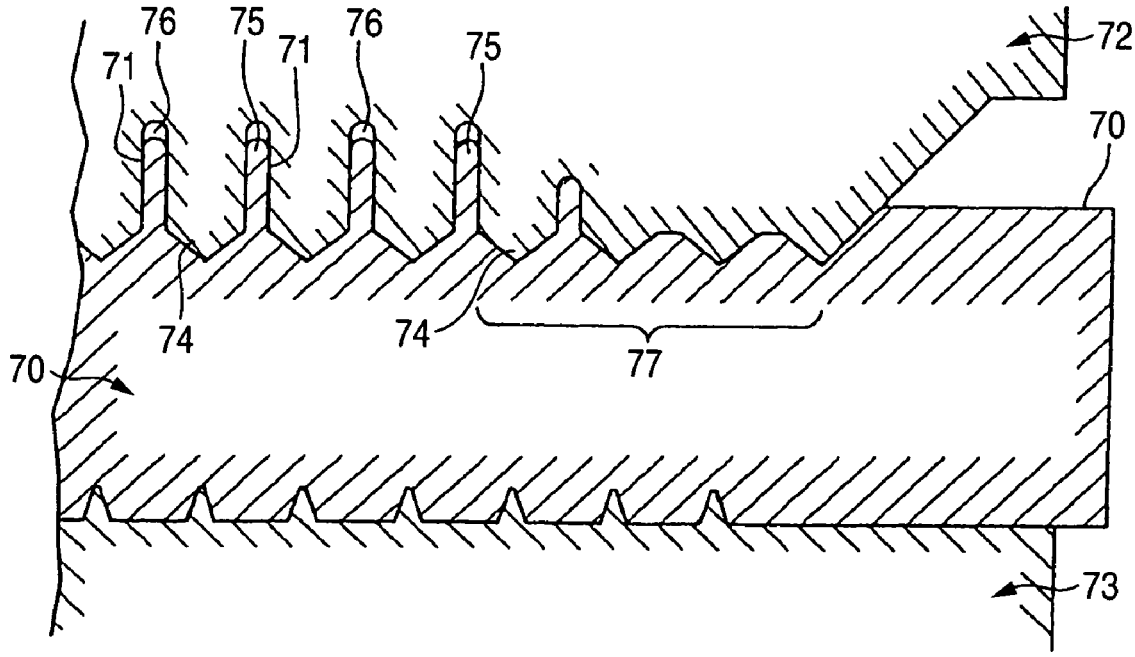
FIG. 19 is a sectional view showing relationships between a first die, a material plate, and a second die in a conventional forging work.

After the formation of the opening 62, as shown in FIGS. 10A to 10D, the chamber formation plate 30 is pressed between the first die 51 and the second die 52, whereby elongated recess portions 33 and 36 are formed. Then, boring punches are dug through the slant faces 33*b* of the longitudinal end portions of the elongated recess portions 33 (cf., FIG. 18C), whereby communicating ports 34 and 39 are formed. The opening 62 is located close to the sides where the communicating ports 34 and 39 are formed.

There will be listed advantages obtained by the above configuration.

When the chamber formation plate 30 is pressed by the first die 51 and the second die 52, plastic flows occur from the array-end elongated recess portions 33 and 36 and move in their longitudinal direction. Carried by the plastic flows, the material reaches the edges 62*c* of the opening 62, whereby the edges 62*c* are deformed. Therefore, the plastic flows occurring from the array-end elongated recess portions 33 and 36 in their longitudinal direction are not restricted, and hence the array-end elongated recess portions 33 and 36 can be given the prescribed length.

In other words, according to the plastic deformation of the opening 62, the amount of the plastic flow in the longitudinal direction of the array-end elongated recess portions 33, 36 is made relatively greater than that in the arrayed direction thereof, and hence the array-end elongated recess portions 33 and 36 can be given the prescribed length.

Further, since as described above plastic flows are permitted around the opening 62 during action of the first die 51, the longitudinal end portions of the array-end elongated recess portions 33 and 36 can be formed sharply.

As a result, when the communicating ports 34 to be communicated with the nozzle orifices 48 and the dummy communicating ports 39 are formed in the end portions of the elongated recess portions 33 and 36, the digging positions of the boring punches are made identical with respect to the elongated recess portions 33 and 36. The life of the boring punches can be elongated by setting the digging positions at positions with as light a working load as possible. Elongating the life of the boring punches makes it possible to, for example, save the cost relating to working tools and increase the replacement cycle of the boring punches. Further, since the accuracy of formation of the elongated recess portions 33 and 36 is increased, the capacity and the shape of the pressure generating chambers 29 are made uniform and the ink ejecting characteristics can thereby be improved.

Figure 14:
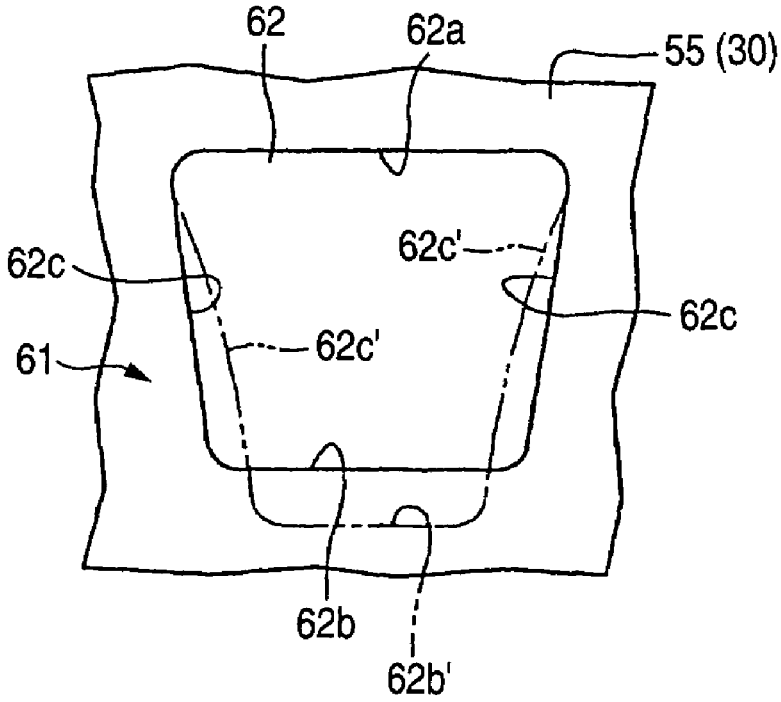
FIG. 14 is a diagram for explaining how a low rigidity portion formed in the chamber formation plate is deformed.

FIG. 14 shows how the trapezoidal opening 62 is deformed as the elongated recess portions 33 and 36 are formed. Solid lines and dashed chain lines indicate shapes before and after formation of the elongated recess portions 33 and 36, respectively. Plastic flows occurring from the elongated recess portions 33 and 36 in their longitudinal direction during their formation push both edges 62*c* inward, whereby the edges 62*c* are deformed plastically into curved edges 62*c*'. When the edges 62*c* are pushed from both sides, the pressing forces are converted into components that are directed toward the shorter side 62*b*, whereby the shorter side 62*b* is moved downward (as viewed in FIG. 14) to become a shorter side 62*b*' that is shorter than the undeformed shorter side 62*b*.

Therefore, after the deformation, the trapezoidal opening 62 has a narrower shape that would be obtained by pushing the original trapezoidal opening 62 from both sides and that remains symmetrical with respect to its center line extending in the arrayed direction of the elongated recess portions 33. As described above, the longer side 62*a* of the opening 62 is located on the side of the dummy recess portion 36 and the edges 62*c* are inclined. Therefore, when stress of plastic flows acts on the opening 62 from both sides, the trapezoidal opening 62 is deformed so as to be elongated toward the side of the shorter side 62*b*, into a longer and narrower shape. The deformation of the opening 62 well conforms to the plastic flows from the elongated recess portions 33 and 36 and hence the longitudinal ends of the array-end elongated recess portions 33 and 36 are aligned straightly.

Figure 13A:
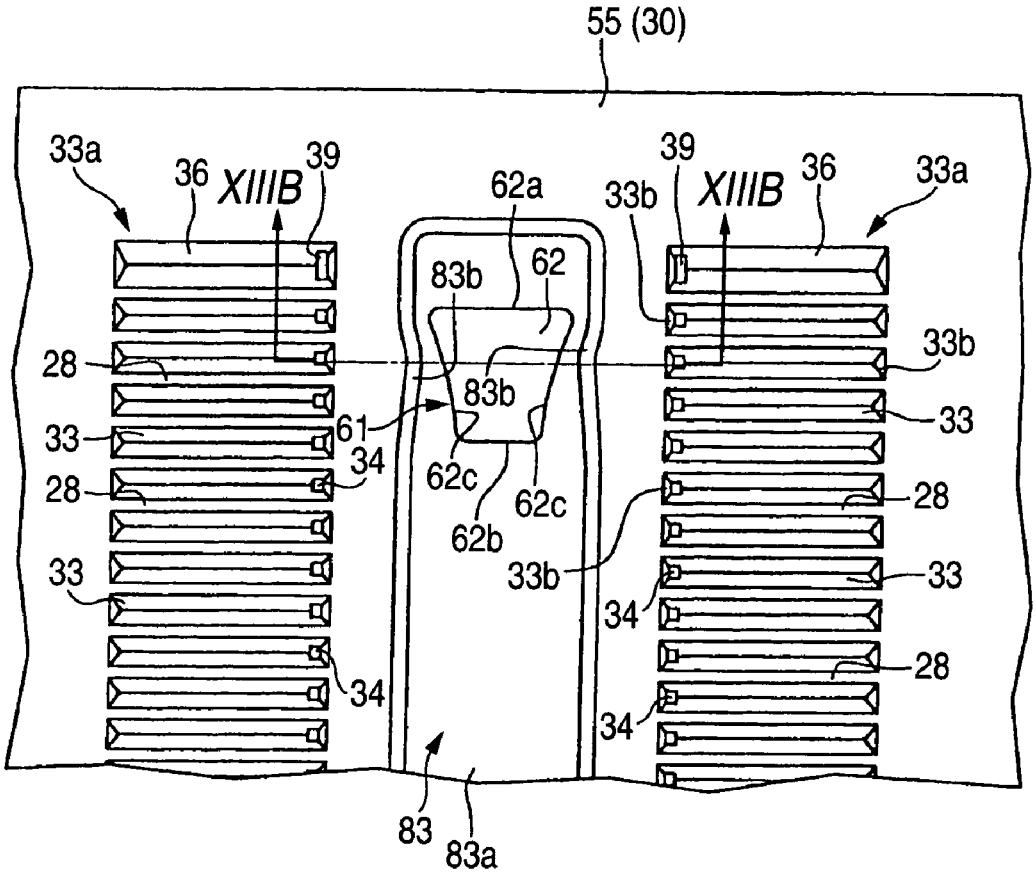
FIG. 13A is a plan view of the chamber formation plate, showing a state after the elongated recess portions are formed.
Figure 13B:
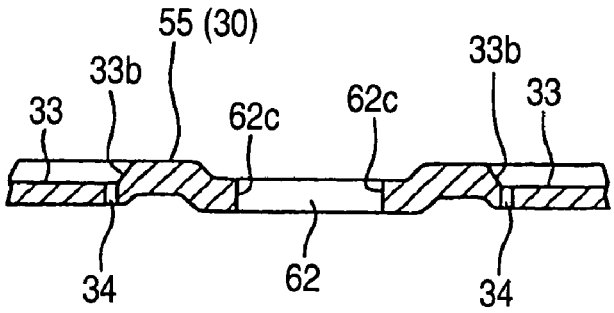
FIG. 13B is a section view taken along a line XIIIB-XIIIB.

As the opening 62 is deformed, the contour of the recess 83 is curved inward near the opening 62 as shown in FIG. 13A. In this figure, the curved portions of the contour are denoted by symbol 83*b* and the degree of curvature is exaggerated to facilitate understanding.

Since the opening 62 is provided on the side closer to the communicating ports 34 and 39 to be formed through the end portions of the elongated recess portions 33 and 36, the parts of the elongated recess portions 33 and 36 and the slant faces 33*b* on the side where the communicating ports 34 and 39 will be formed are formed correctly, that is, given the prescribed length and shape, respectively. Therefore, the communicating ports 34 and 39 can be formed correctly at uniform positions through the end portions of all the elongated recess portions 33 and 36.

Since the opening 62 is provided between the two arrays 33*a* of elongated recess portions, the lengths of the two sets of abnormal elongated recess portions can be corrected by the single opening 62, which is efficient.

Since the opening 62 penetrates through the chamber formation plate 30, the opening 62 can be formed by simple punching as part of the preforming process, whereby the manufacturing process is simplified. Moreover, the deformation of the opening 62 well conforms to plastic flows occurring from the elongated recess portions 36 in the longitudinal direction.

Since the opening 62 has a trapezoidal shape, the distance between the edge 62*c* of the opening 62 and the longitudinal end of the dummy recess portion 36 (at which the amount of plastic flow is larger) is made shorter. Therefore, a plastic flow from the dummy recess portion 36 reaches the opening 62 immediately, whereby the portion of the opening 62 close to the longer side 62*a* is given largest plastic deformation. On the other hand, since the distances between the edge 62*c* and the longitudinal ends of elongated recess portions 33 that are distant from the dummy recess portion 36 (at which the amount of plastic flow is smaller) are made longer, plastic flows from those elongated recess portions 33 do not reach the opening 62 immediately, whereby the portion of the opening 62 close to the shorter side 62*b* is given only slight plastic deformation.

In other words, the distances are set in accordance with the necessary amounts of plastic flows occurring from the elongated recess portions 33 and 36 in the longitudinal direction thereof. As a result, the lengths of the elongated recess portions 33 and 36 are equalized and the longitudinal ends are aligned straightly.

Since the opening 62 is formed in the recess 83 that extends in the arrayed direction of the elongated recess portions 33 and 36, the single recess 83 realizes securing of sufficient flatness of the chamber formation plate 30 and correction of the lengths of abnormal elongated recess portions, thereby simplifying the manufacturing process.

Since the positional relationship between the opening 62 and the elongated recess portions 33 and 36 is set with high accuracy, the opening 62 can be used as a positioning member for the plastic working.

Figure 15:
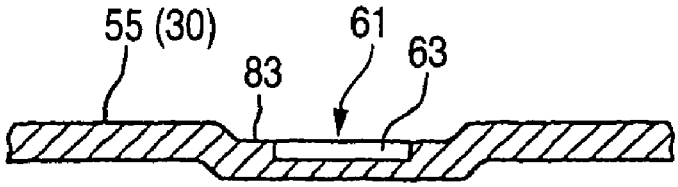
FIG. 15 is a section view of a chamber formation plate according to a second embodiment of the invention.

In order to obtain the same advantages as described the above, the low rigidity portion 61 may be formed as a recess 63 by denting the chamber formation plate 30 in its thickness direction as shown in FIG. 15, instead of the opening 62 that penetrates through the plate 30. When plastic flows occur from the elongated recess portions 33 and 36 in the longitudinal direction thereof, the plate 30 is deformed so as to go into the space of the recess 63 from both sides of the recess 63. The plastic flows are thus permitted.

Since the recess 63 is formed by denting the chamber formation plate 30 in its thickness direction, it can be formed by simple press working in the preforming process and hence the manufacturing process can be simplified. Because of its recessed shape, selecting the depth of the recess 63 properly allows the recess 63 to be deformed so as to well conform to plastic flows occurring from the elongated recess portions 33 and 36 in the longitudinal direction thereof.

Figure 16:
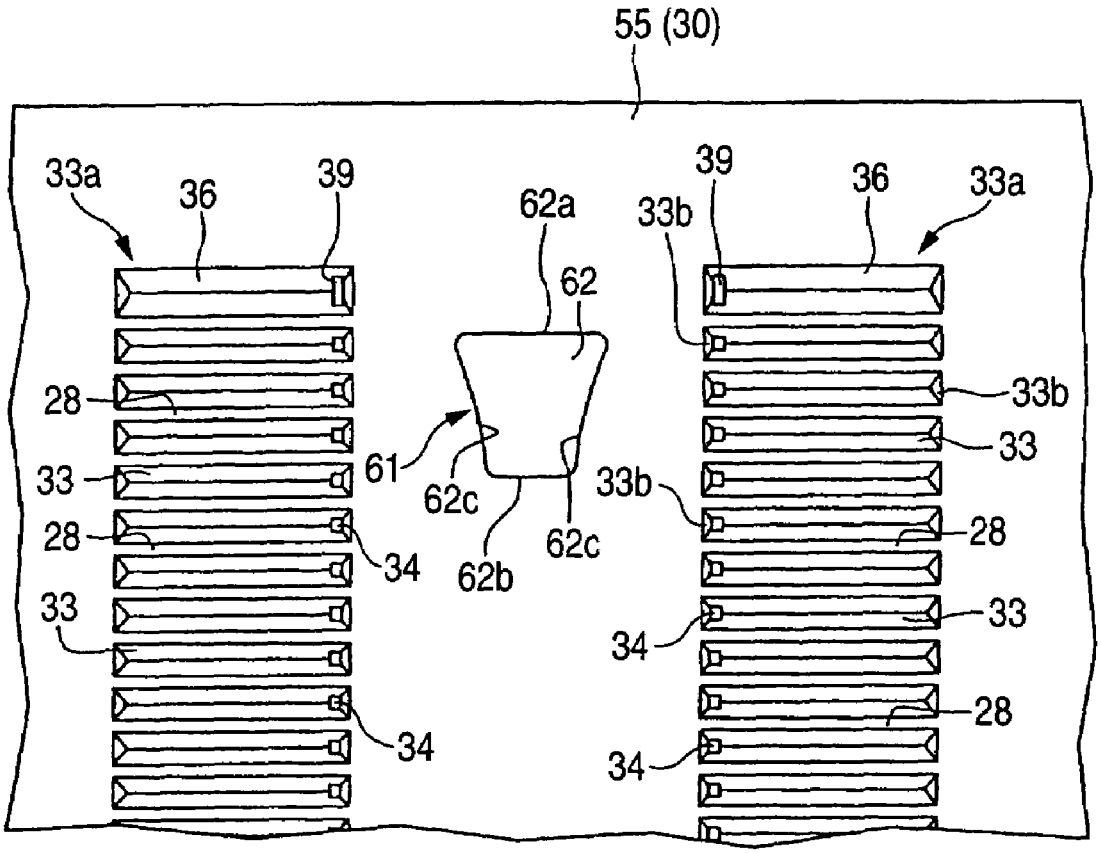
FIG. 16 is a section view of a chamber formation plate according to a third embodiment of the invention.
Figure 17:
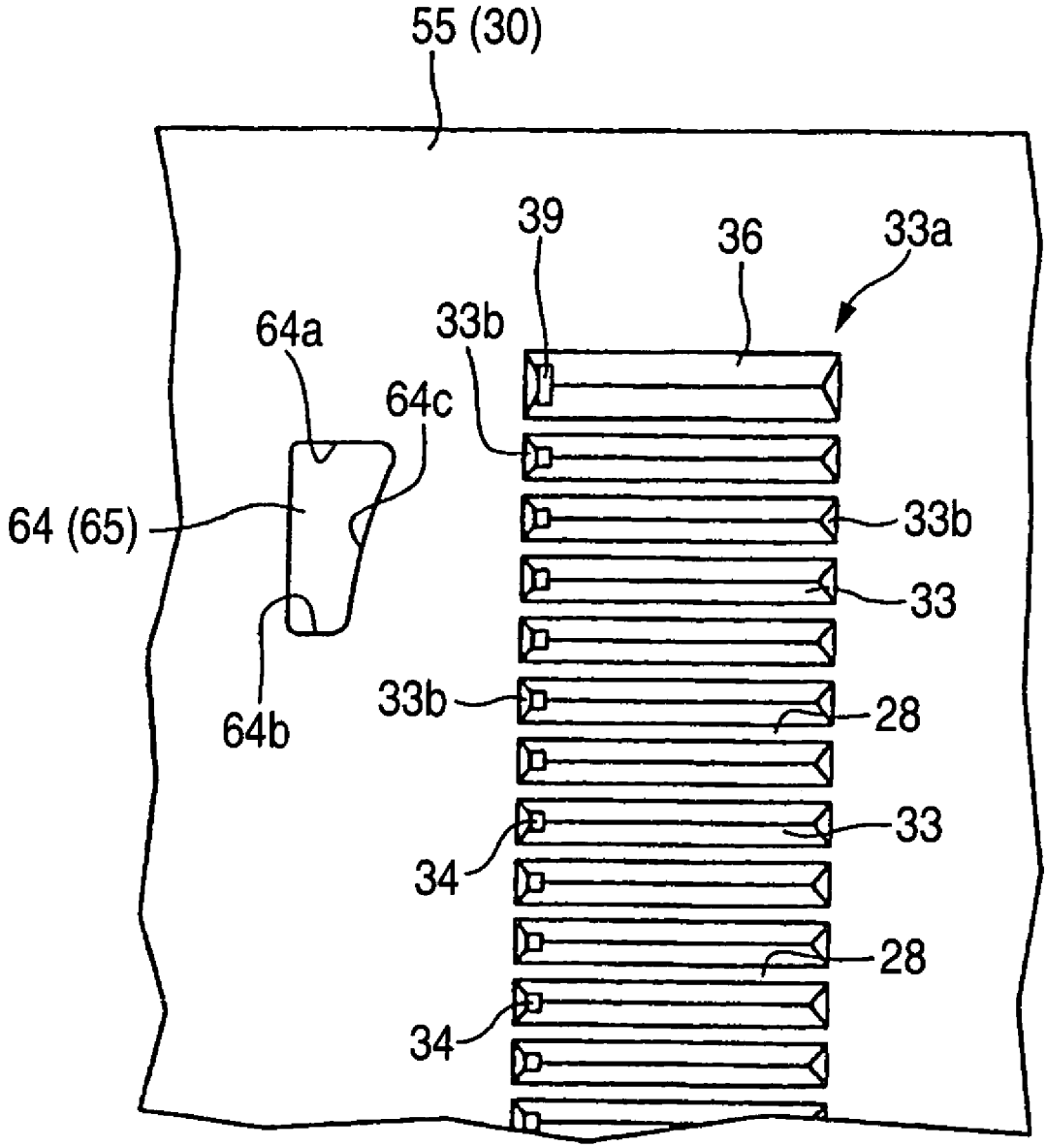
FIG. 17 is a section view of a chamber formation plate according to a fourth embodiment of the invention.

The recess 83 may be omitted as shown in FIG. 16. Further, the chamber formation plate 30 may be configured to comprise a single array 33*a* of elongated recess portions 33 and 36 as shown in FIG. 17. In this case, the low rigidity portion 61 is an asymmetrical trapezoid version of the symmetrical trapezoid opening 62 or recess 63 of the above embodiment. That is, this embodiment is provided with an asymmetrical opening 64 (or a recess 65) having a longer side 64*a*, a shorter side 64*b* and an edge 64*c* connecting the longer side 64*a* and the shorter side 64*b*. Since any others are the same as explained with reference to the first embodiment, the repetitive explanations for those will be omitted.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

For example, the invention is applicable to a color filter manufacturing apparatus to be used for manufacturing a color filter of a liquid-crystal display. In this case, a coloring material ejection head of the apparatus is an example of the liquid ejection head. Another example of the liquid ejection apparatus is an electrode formation apparatus for forming electrodes, such as those of an organic EL display or those of a FED (Field Emission Display). In this case, an electrode material (a conductive paste) ejection head of the apparatus is an example of the liquid ejection head. Still another example of the liquid ejection apparatus is a biochip manufacturing apparatus for manufacturing a biochip. In this case, a bio-organic substance ejection head of the apparatus and a sample ejection head serving as a precision pipette correspond to examples of the liquid ejection head. The liquid ejection apparatus of the invention includes other industrial liquid ejection apparatuses of industrial application.

What is claimed is:

1. A method of manufacturing a liquid ejection head which ejects liquid droplets from nozzle orifices by generating pressure fluctuation in liquid contained in a plurality of pressure generating chambers communicated with the nozzle orifices, the method comprising steps of:

providing a metallic plate member;

providing a first die, in which a plurality of projections are arrayed in a first direction with a fixed pitch to form at least one array of the projections, each of the projections being elongated in a second direction perpendicular to the first direction, the first die facing a first face of the plate member;

providing a second die, opposed to the first die while supporting a second face of the plate member;

forming at least one first region on the plate member so as to have a less rigidity than another region of the plate member;

approaching the first die and the second die, so that the projections are dug into a second region in the first face of the plate member, the projections being pressed in a third direction orthogonal to the first direction and the second direction, so as to generate a plastic flow of a material in the plate member into gaps defined between the projections, thereby forming partitioned recesses to be the pressure generating chambers, wherein the at least one first region is adjacent to at least one of ends in the first direction of the second region, such that the first region and the second region are arranged in the second direction;

wherein the projections in the first die is arranged so as to form two arrays of the projections; and wherein the first region is placed between two arrays of the projections when the projections are dug into the plate member.

2. The manufacturing method as set forth in claim 1, further comprising a step of forming a through hole in each of the partitioned recesses, the through hole to be a passage communicating one of the pressure generating chambers and one of the nozzle orifices, wherein the through hole is formed in the vicinity of one end in the second direction of each of the partitioned recesses, which opposes to the first region.

3. The manufacturing method as set forth in claim 1, wherein a through hole is formed in the first region.

4. The manufacturing method as set forth in claim 1, wherein a recess is formed in the first region.

5. The manufacturing method as set forth in claim 1, wherein a distance between the first region and the second region is made shorter as coming closer to an end in the first direction of the second region.

6. The manufacturing method as set forth in claim 1, further comprising a step of forming a recess extending in the first direction, such that the first region is situated within the recess.

7. A method of manufacturing a liquid ejection head which ejects liquid droplets from nozzle orifices by generating pressure fluctuation in liquid contained in a plurality of pressure generating chambers communicated with the nozzle orifices, the method comprising steps of:

providing a metallic plate member;

providing a first die, in which a plurality of projections are arrayed in a first direction with a fixed pitch to form at least one array of the projections, each of the projections being elongated in a second direction perpendicular to the first direction, the first die facing a first face of the plate member;

providing a second die, opposed to the first die while supporting a second face of the plate member;

forming at least one first region on the plate member so as to have a less rigidity than another region of the plate member;

approaching the first die and the second die, so that the projections are dug into a second region in the first face of the plate member, the projections being pressed in a third direction orthogonal to the first direction and the second direction, so as to generate a plastic flow of a material in the plate member into gaps defined between the projections, thereby forming partitioned recesses to be the pressure generating chambers, wherein the at least one first region is adjacent to at least one of ends in the first direction of the second region, such that the first region and the second region are arranged in the second direction; and wherein the first region has a trapezoidal shape such that a longer side is made closer to the end in the first direction of the second region.

8. The manufacturing method as set forth in claim 7, wherein:

the projections in the first die is arranged so as to form two arrays of the projections; and the trapezoidal shape is symmetrical with respect to a line extending in the first direction.

* * * * *